US008062238B2

(12) United States Patent
Lindblad

(10) Patent No.: US 8,062,238 B2
(45) Date of Patent: Nov. 22, 2011

(54) DEVICE AT A SO-CALLED BACK BENCH FOR ARRESTING THE LYING PART OF THE BENCH IN DESIRED ANGULAR SETTING

(75) Inventor: Hans Lindblad, Alingsås (SE)

(73) Assignee: Mastercare AB, Skara (SE)

( * ) Notice: Subject to any disclaimer, the term of this patent is extended or adjusted under 35 U.S.C. 154(b) by 459 days.

(21) Appl. No.: 12/303,731

(22) PCT Filed: Jun. 25, 2007

(86) PCT No.: PCT/SE2007/050461

§ 371 (c)(1),
(2), (4) Date: Dec. 23, 2008

(87) PCT Pub. No.: WO2008/002262

PCT Pub. Date: Jan. 3, 2008

(65) Prior Publication Data

US 2010/0042148 A1 Feb. 18, 2010

(30) Foreign Application Priority Data

Jun. 27, 2006 (SE) ..... 0601395

(51) Int. Cl.
*A63B 26/00* (2006.01)

(52) U.S. Cl. ..... 601/23; 606/244; 482/144

(58) Field of Classification Search ..... 601/23, 601/24; 606/240, 241, 242, 244, 245; 482/143, 482/144, 145

See application file for complete search history.

(56) References Cited

U.S. PATENT DOCUMENTS

| | | | | |
|---|---|---|---|---|
| 4,867,143 | A * | 9/1989 | Morin | 606/244 |
| 5,551,937 | A * | 9/1996 | Kwo | 482/144 |
| 6,679,818 | B2 * | 1/2004 | Hsien | 482/144 |
| 7,052,448 | B2 * | 5/2006 | Teeter | 482/144 |
| 7,077,795 | B2 * | 7/2006 | Chen | 482/145 |

* cited by examiner

*Primary Examiner* — Quang D Thanh

(74) *Attorney, Agent, or Firm* — Potomac Patent Group PLLC

(57) ABSTRACT

The invention relates to a device (1) at a so-called back bench (2) and comprises a lying part (6) that is supportable by a stand (3), turnably mounted around a pivot joint (5), and movable along the length extension (8) thereof, as well as a mechanism (9) for manual actuation of the arresting of said lying part (6) in the desired angular setting, and having clamping members (10) for the clamping of persons' legs. According to the invention, the arresting mechanism (9) is formed of a push rod (11), the intermediate portion (HB) of which has an angled portion (30), and which is received internally in one of the tubes (14) included in the pairs of legs (13) of the back bench all the way from the outer free end (15) thereof to an opening (17) arranged on the side (16) of said tube (14), and that the lower portion (HC) of the push rod, which is angled at an obtuse angle to an arresting portion (18) formed, is arranged receivably in a number of stoppers situated at mutual distances from each other, on an arresting part arranged.

13 Claims, 15 Drawing Sheets

DEVICE AT A SO-CALLED BACK BENCH FOR ARRESTING THE LYING PART OF THE BENCH IN DESIRED ANGULAR SETTING

The present invention relates to a device at a so-called back bench comprising a lying part that is supportable by a stand, turnably mounted around a pivot joint, and movable along the length extension thereof, as well as a mechanism for manual actuation of the arresting of said lying part in the desired angular setting, and having clamping members for the clamping of persons' legs.

At known means of assistance used to treat bad backs and provide comfort to the persons utilizing the means of assistance in question, see among others U.S. Pat. No. 4,867,143 A, the Russian patent no 858821, and U.S. Pat. No. 4,531,731 A, there are devices having mechanisms intended to be capable of setting the intended back lying board of the means of assistance in question at the desired angle. However, the mechanisms presented in that connection are, among other things, complicated to assemble, manufacture and use. Among other things, some mechanism comprises double actuation buttons and some one comprises a mechanism that does not allow to be set by the person already lying on the intended movable back board.

A known solution comprises a mechanism that is allowed to be introduced internally into a tube belonging to the leg stand of the back bench. Such tubes are often manufactured so that an internal seam is formed along the length extension of the tube, which entails that the mechanism may get caught at said seam and get stuck. Furthermore, the assembling of the mechanism is made more difficult by said seam. In that connection, it has been cumbersome to allow the introduction of a spring in the bottom of the tube.

Therefore, the main object of the present invention is primarily, among other things, to solve said problems in an efficient and reliable way and that allows producing a mechanism that consists of few parts.

Said object is attained by means of a device according to the present invention, which essentially is characterized in that the arresting mechanism is formed of a push rod, the intermediate portion of which has an angled portion, and which is received internally in one of the tubes included in the pairs of legs of the back bench all the way from the outer free end thereof to an opening arranged on the side of said tube, and that the lower portion of the push rod, which is angled at an obtuse angle to an arresting portion formed, is arranged receivably in a number of stoppers situated at mutual distances from each other, on an arresting part arranged.

Figure 1:
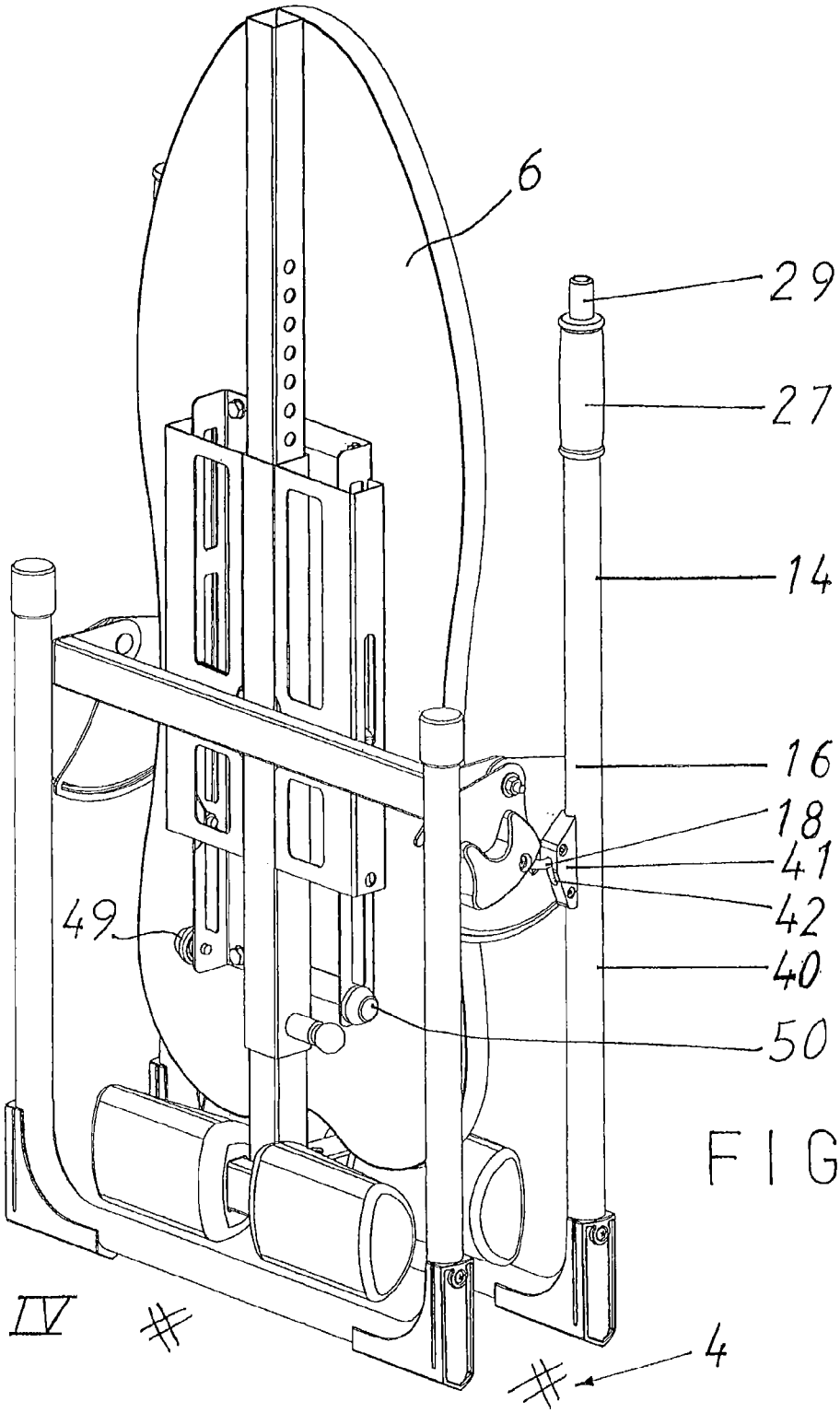
Figure 2:
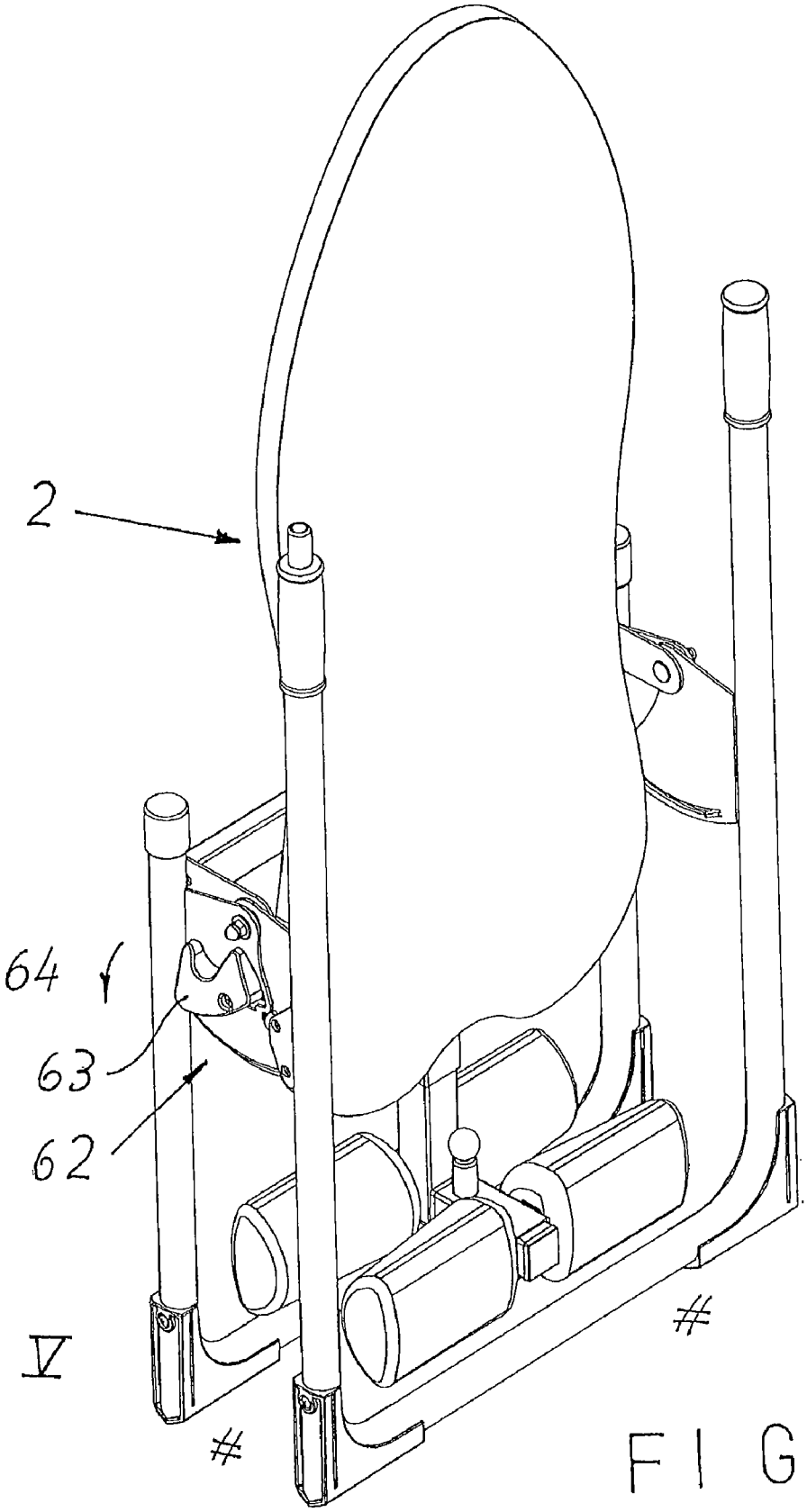
Figure 3:
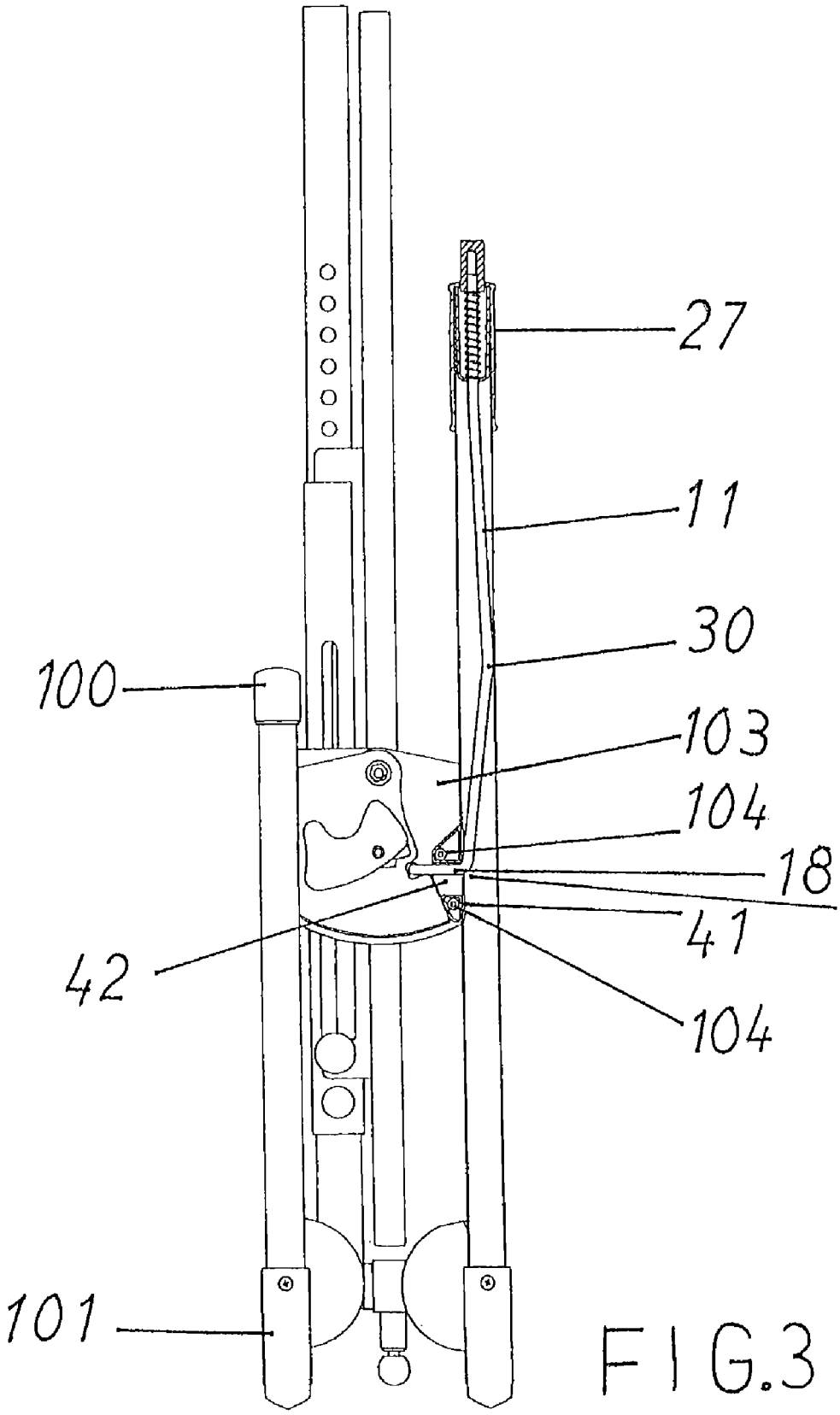
Figure 3A:
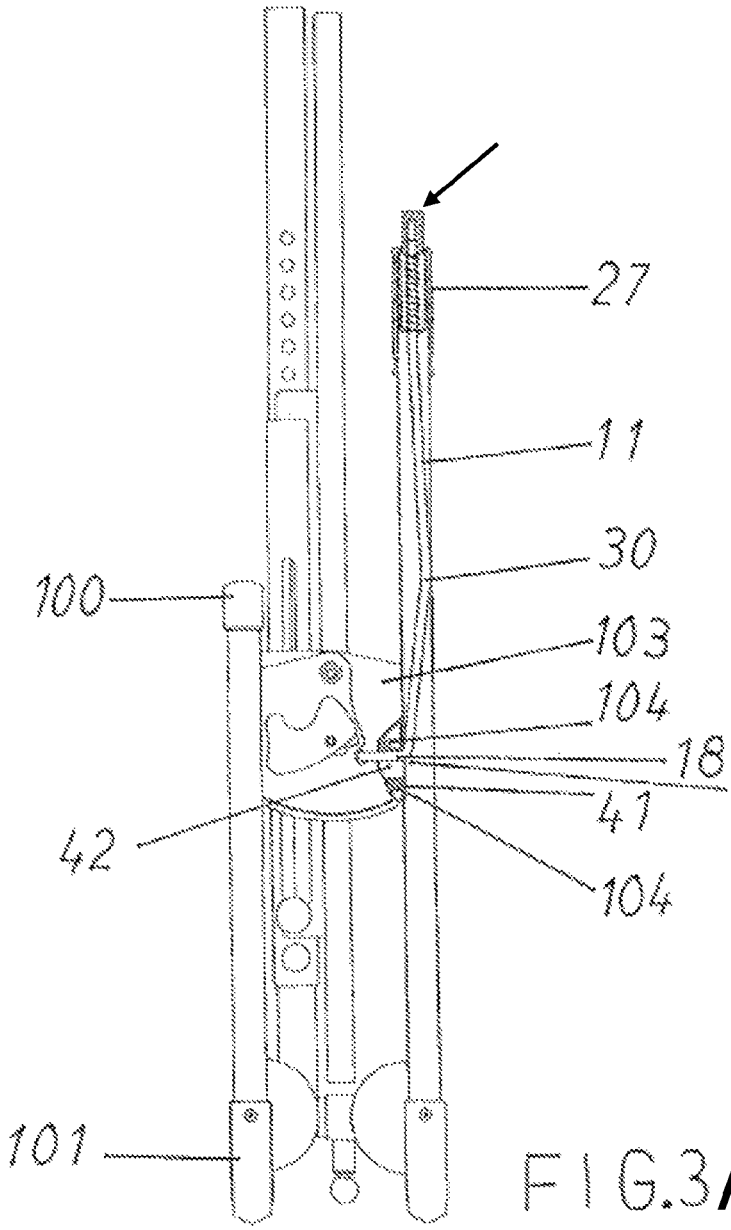
Figure 3B:
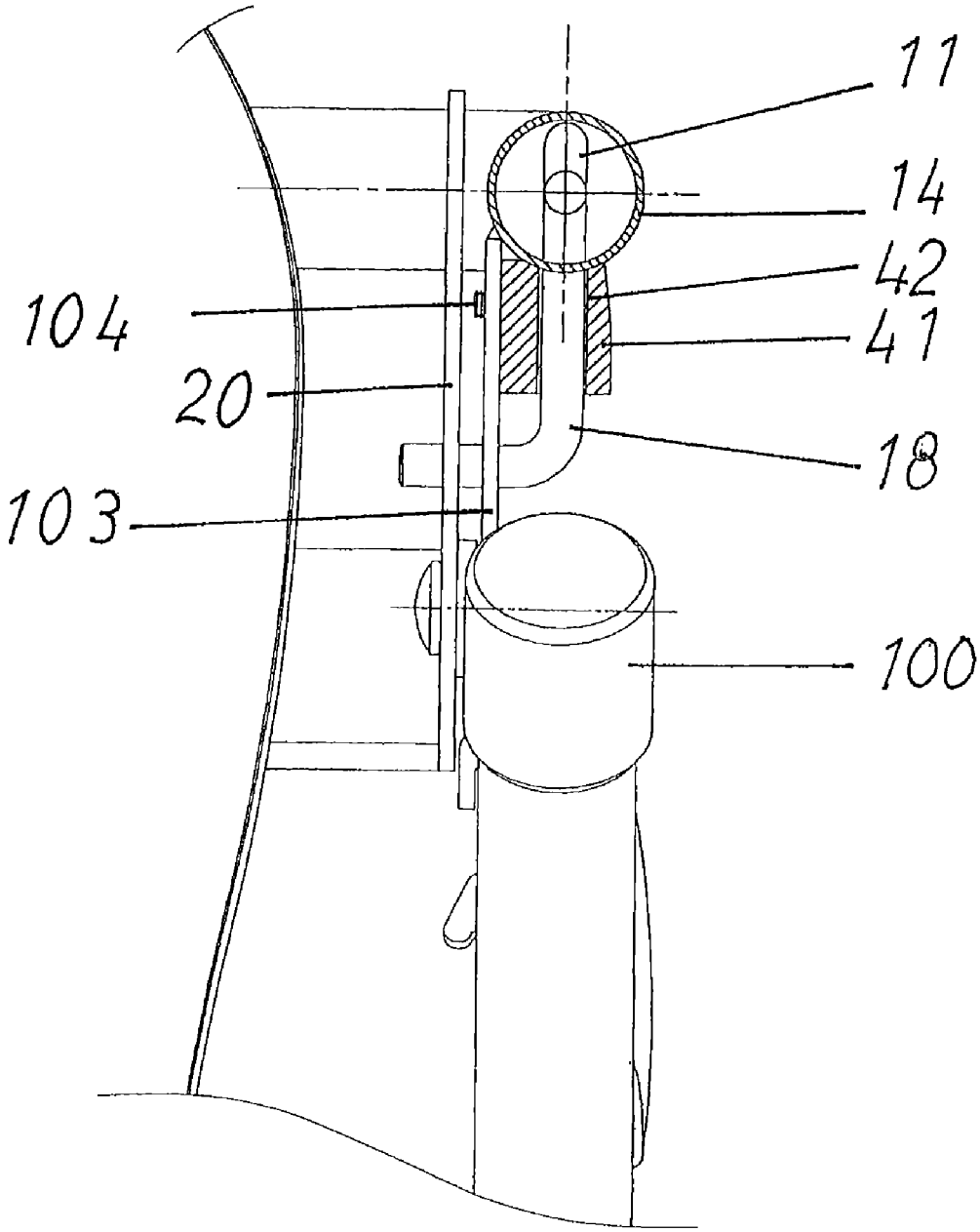
Figure 4:
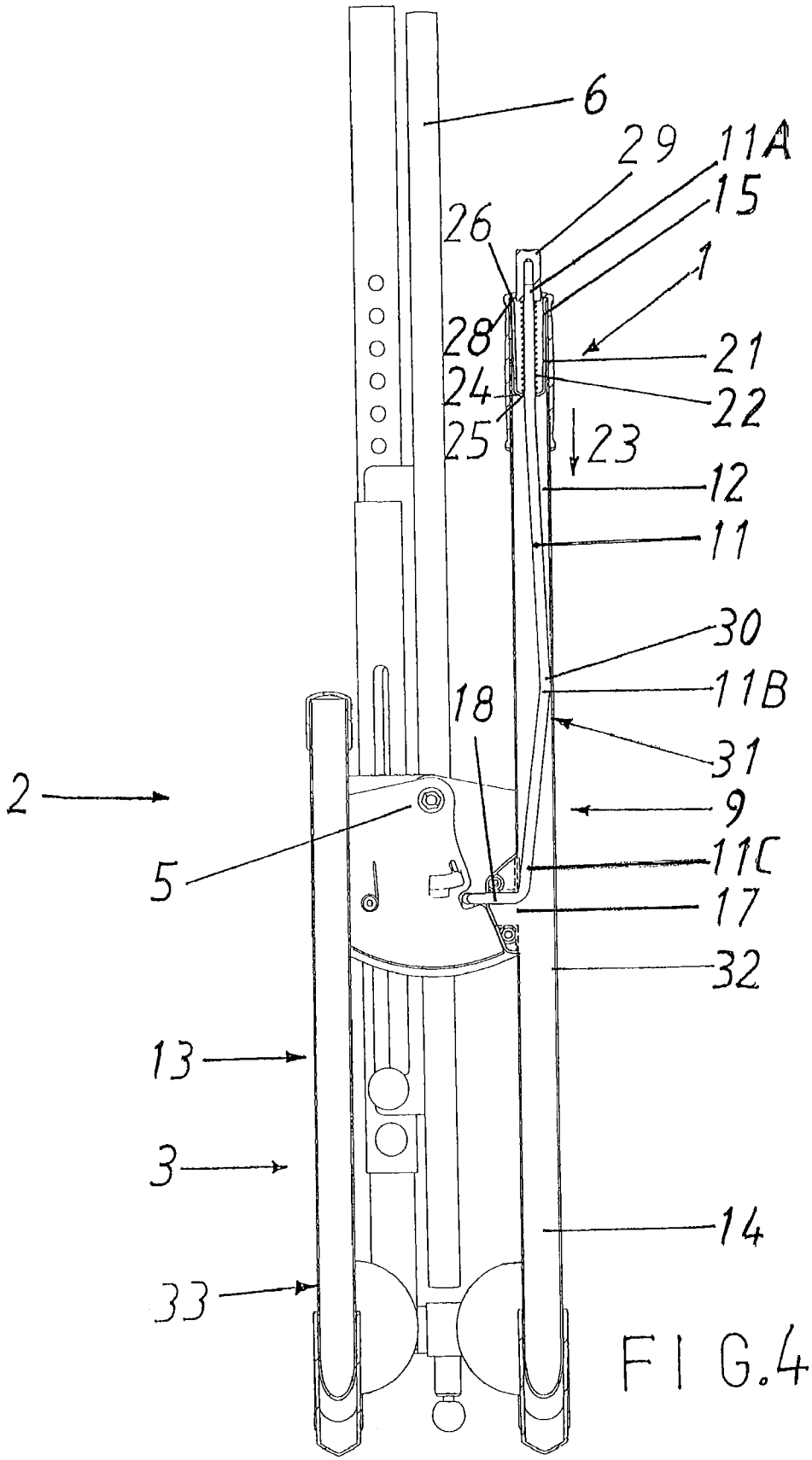
Figure 5:
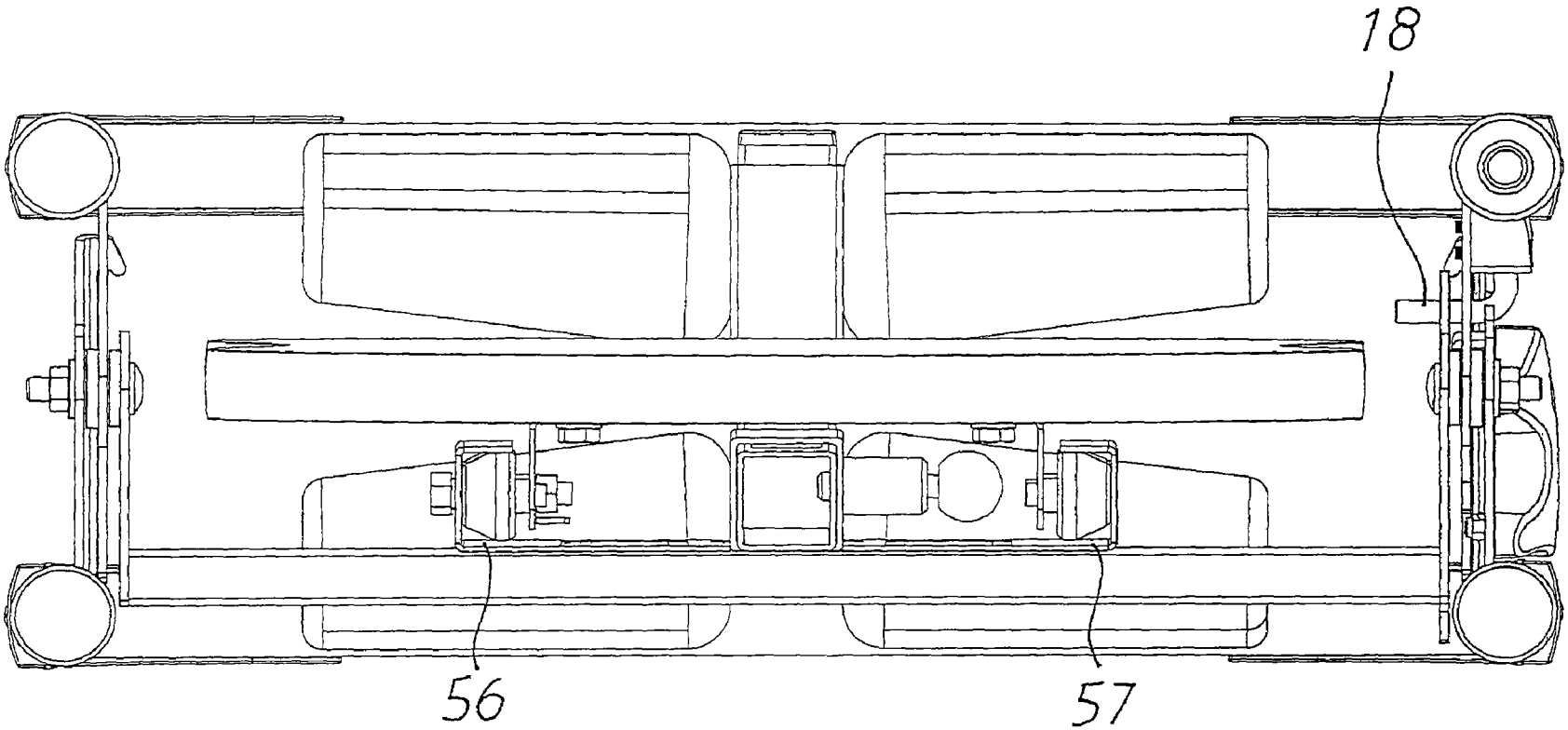
Figure 6:
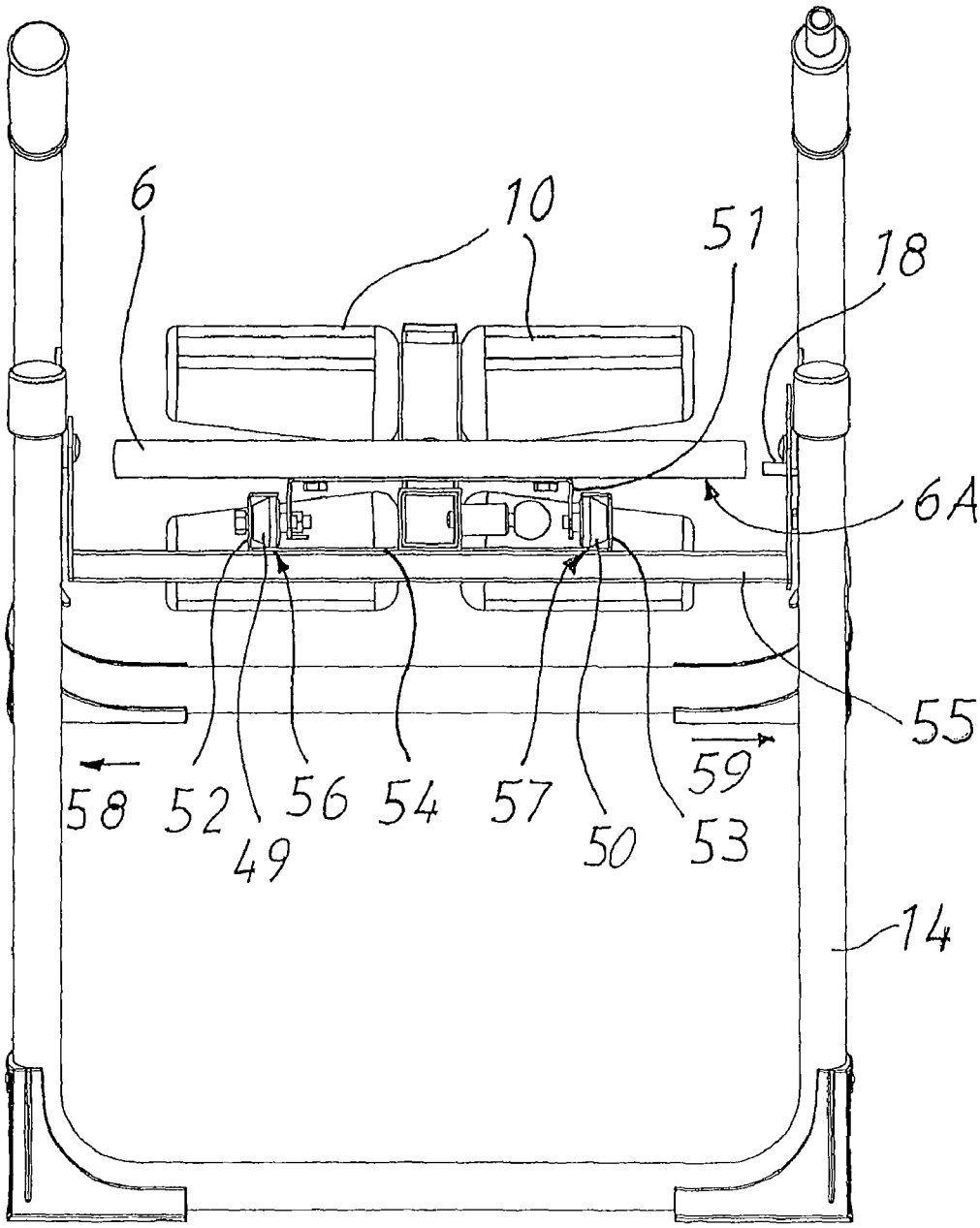
Figure 7:
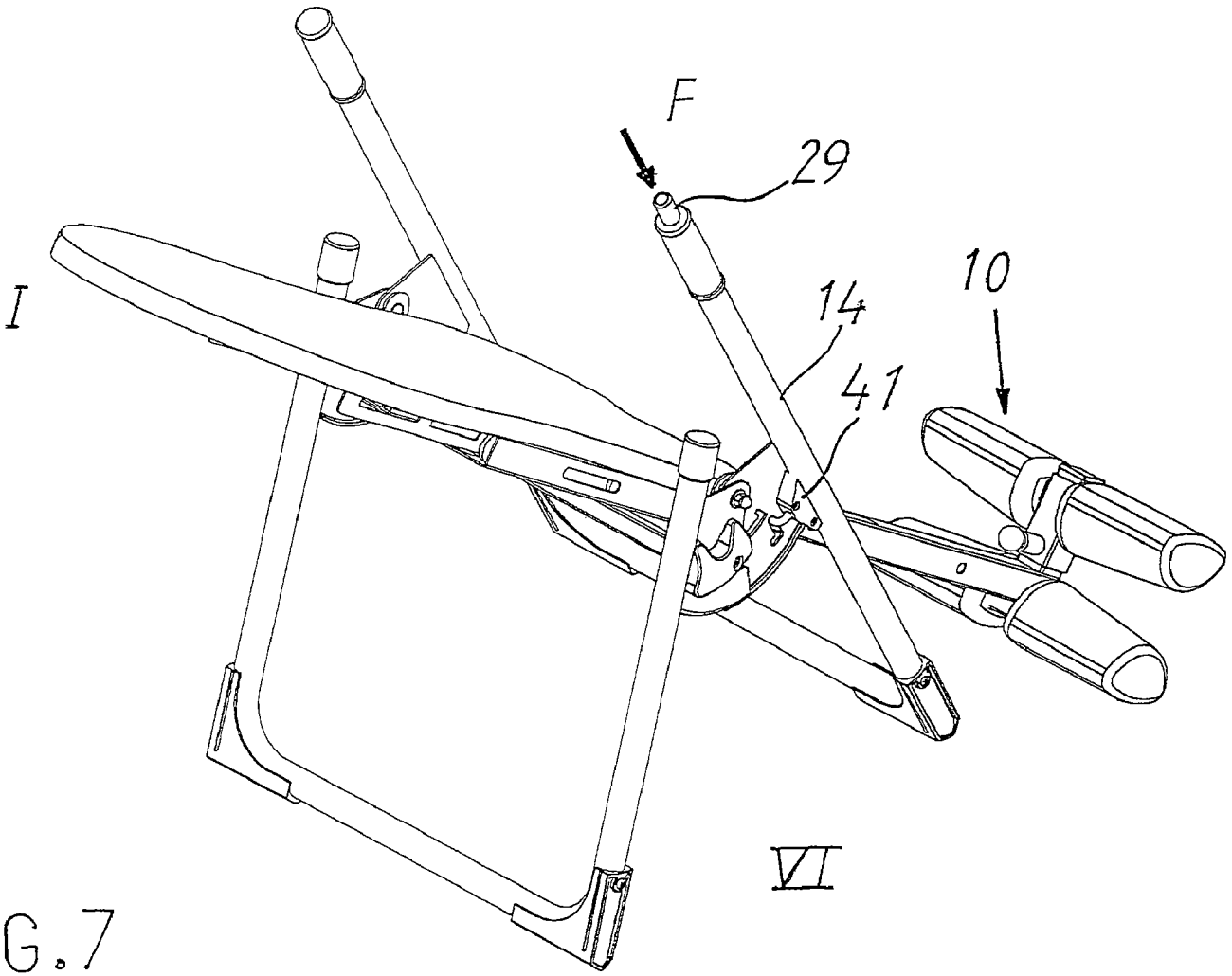
Figure 12:
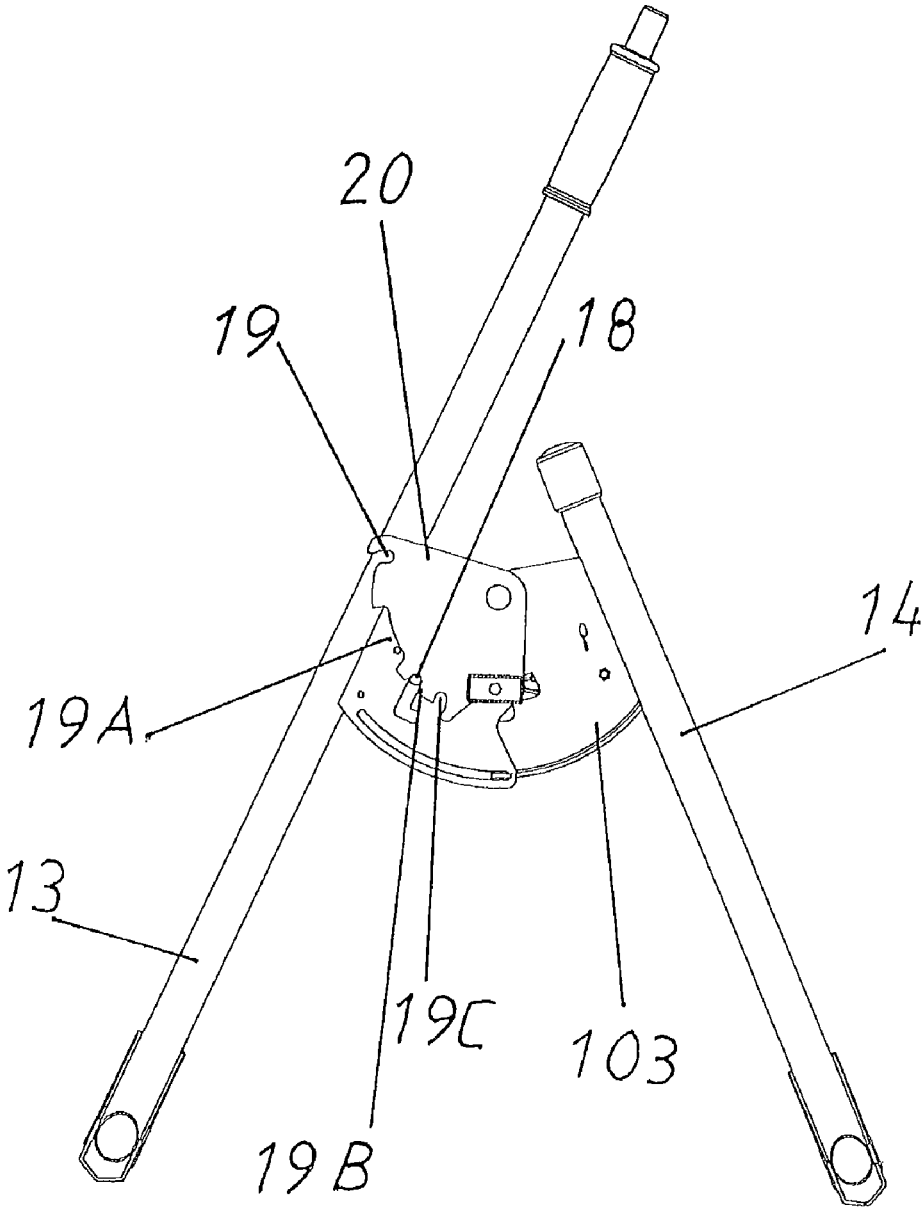

The invention is described below as a preferred embodiment example, reference being made to the accompanying drawings in which, FIG. 1 shows a back bench having a mechanism according to the invention and in a collapsed, raised transport position, as seen obliquely from behind, FIG. 2 shows the back bench in a transport position as seen obliquely from the front, FIG. 3 shows the back bench in the transport position as seen from the side, FIG. 3A shows one of the pairs of legs of the back bench in section having a mechanism shown therein, FIG. 3B shows a detailed section view of the mechanism, FIG. 4 shows the back bench in the transport position as seen from the side and in a partly sectioned view, FIG. 5 shows the back bench in a transport position as seen straight from above, FIG. 6 shows a front view of the back bench in a lowered position prepared for lying down, FIGS. 7-11 show the lying bench in perspective views in an "entering position", a "horizontal position" and a "treatment position", respectively, and FIG. 12 shows the mechanism in an active position when the back bench is standing raised on a support.

In the drawings, there is shown, in different positions, a device 1 at a so-called back bench 2 of a type previously known per se, which comprises a lying part 6 that is supportable by a stand 3, turnably mounted around a pivot joint 5, and movably 7 arranged, i.e., displaceable along the length extension 8 thereof, which stand is intended and arranged to be raised on the floor 4 or another support. Said device 1 also comprises a mechanism 9 intended and arranged for manual actuation of the arresting of said lying part 6 in the desired angular setting I, II, III, and having clamping members 10 that allow to clamp the legs of the person utilizing said back bench 2.

According to the present invention, an arresting mechanism 9 in question is formed of a bent push rod 11 received internally in a space 12 formed in one of the tubes 14 included in the pairs of legs 13 of the back bench all the way from the outer free end 15 of the tube 14 in to an opening 17 arranged on the inside 16 of said tube 14, and having an angled arresting portion 18. Said angled arresting portion 18 is arranged to be receivable in a number of stoppers 19, 19A, 19B, 19C situated at mutual distances from each other on an arresting part 20 arranged, see FIG. 11.

In that connection, the upper free end portion 11A of said push rod 11 is received in a reception part 21, which in turn is received internally in said tube 14, and is actuable by a spring 22 to be pressed in the downward direction 23. This spring 22, which preferably is in the form of a helical compression spring, is arranged to be received in said reception part 21, and which reception part 21 preferably is formed of a plastic cup having a hole 25 in the bottom 24. Through said bottom hole 25, the push rod 11 extends, and the cup is secured in the tube 14 by means of an upper end stopper 26 of the cup 21 and a surrounding gripping handle 27 at the upper free end of said tube. Said end stopper 26, which is formed of an outer fold, abuts in turn against the end edge 28 of the outer free end 15 of the tube.

An actuation button 29 is, in turn, attached on the outer end 11A of said push rod. The spring 22 is stretched between a button 29 and the bottom portion 24 of the cup. In order for the mechanism 9 to be assembled easily and capable of working satisfactory, the intermediate portion 11B of said push rod has an angled deflected portion 30. The lower portion 11C of the push rod, which is angled at an obtuse angle to the formed arresting portion 18 via a number of angles, is arranged to be displaceably received in a slot-shaped opening 17 on one side 16 of the tube 14, viz. the inside. By inside, it should be understood the side of a U-shaped leg-supporting portion 32 that is interconnectable with another U-shaped leg-supporting portion 33, and which are articulately connected to each other via a pivot joint 5. The leg-supporting portions 32, 33 are connected to each other via bolts 34, 35 received in openings of fastening ears 36, 38; 37, 39 on the respective leg-supporting portions 32, 33.

An add-on member 41 attached on the tube 14 and facing away from the external envelope surface 40 thereof, which add-on member preferably is formed of a plastic block provided with a slot-shaped through opening 42 receiving the bent portion 11C of the push rod when the push rod 11 has been installed in place in the tube 14, has a slot-shaped reception channel situated right opposite the lateral opening 17 in the tube 14 and arranged so that it guides the regulating push rod 11 and prevents the same from turning non-allowable.

The assembling of the mechanism and the appurtenant parts thereof is preferably made according to the method given below: First, a formed loose push-rod guide 41 is threaded onto the lower portion 11C of the formed push rod 11 on the angled lower part thereof, where the arresting portion 18 of the push rod is formed. The push rod 11 and the front straight outer end 11A thereof are then run in through the slot-shaped lateral opening 17 in the U-bent stand tube 14 until the lower part of the push rod 11 is right opposite an opening 102 in a front stand plate 20 preferably situated to the right, the lower part 11C of the push rod being turned axially so that the angled arresting portion 18 arrives in a position 90° to the plane of said stand plate 20. Simultaneously, also the push-rod guide 41 is turned into the correct position in relation to said stand plate 20. Said stand plate 20 is turnably mounted to a fastening ear 103 on one of the legs 14. Next, the push-rod guide 41 is attached to said stand plate 20 by means of screws 104.

Figure 8:
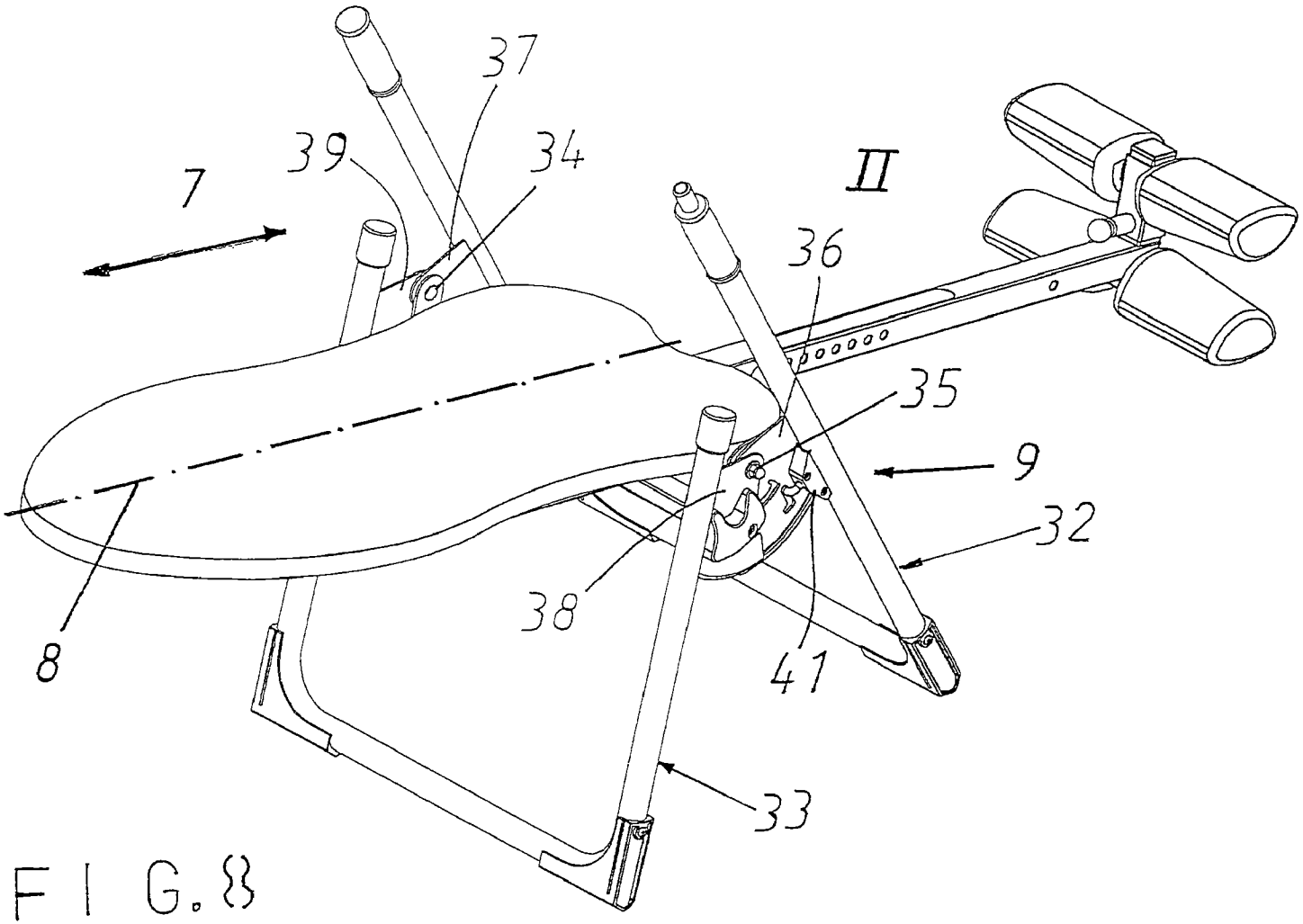
Figure 8A:
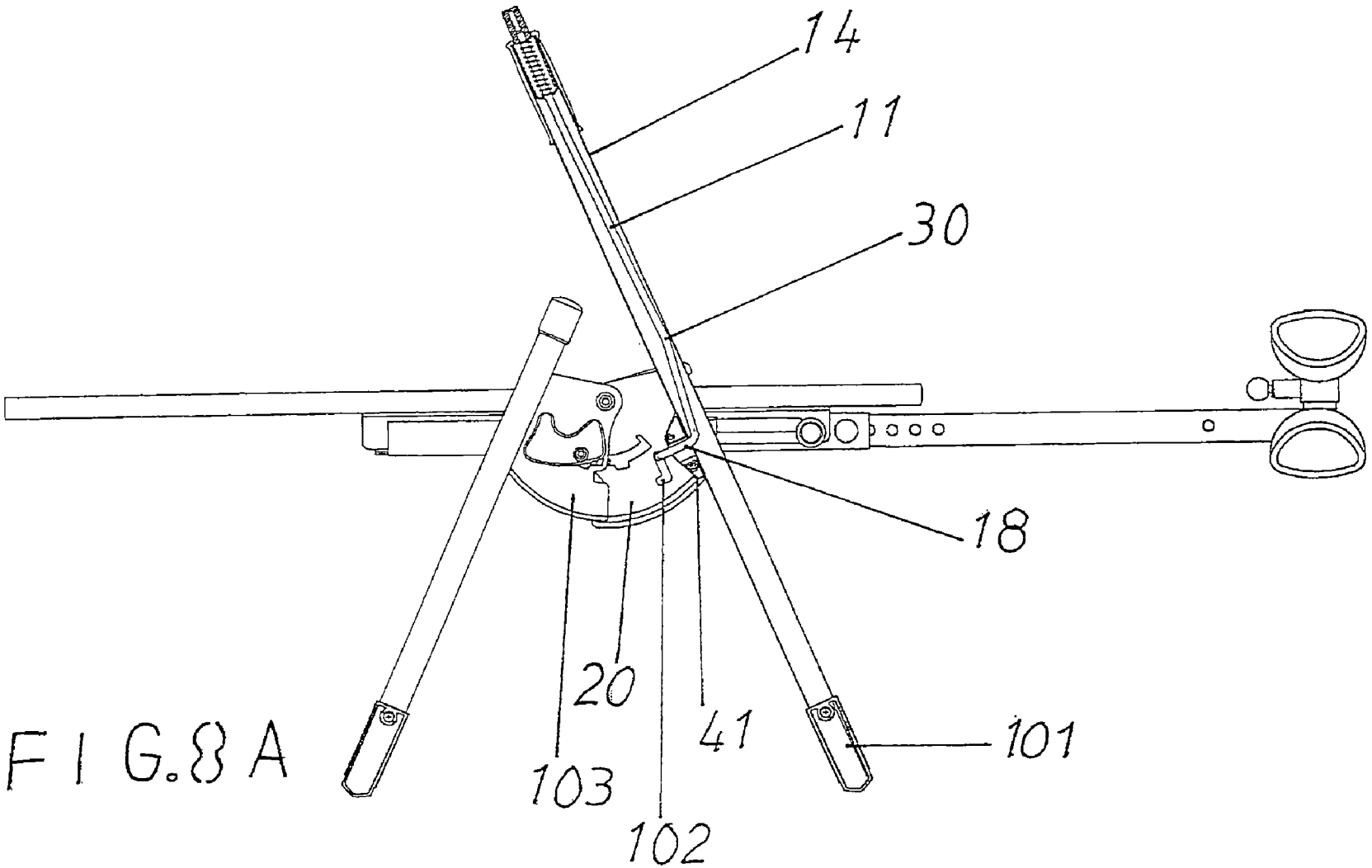
Figure 3:
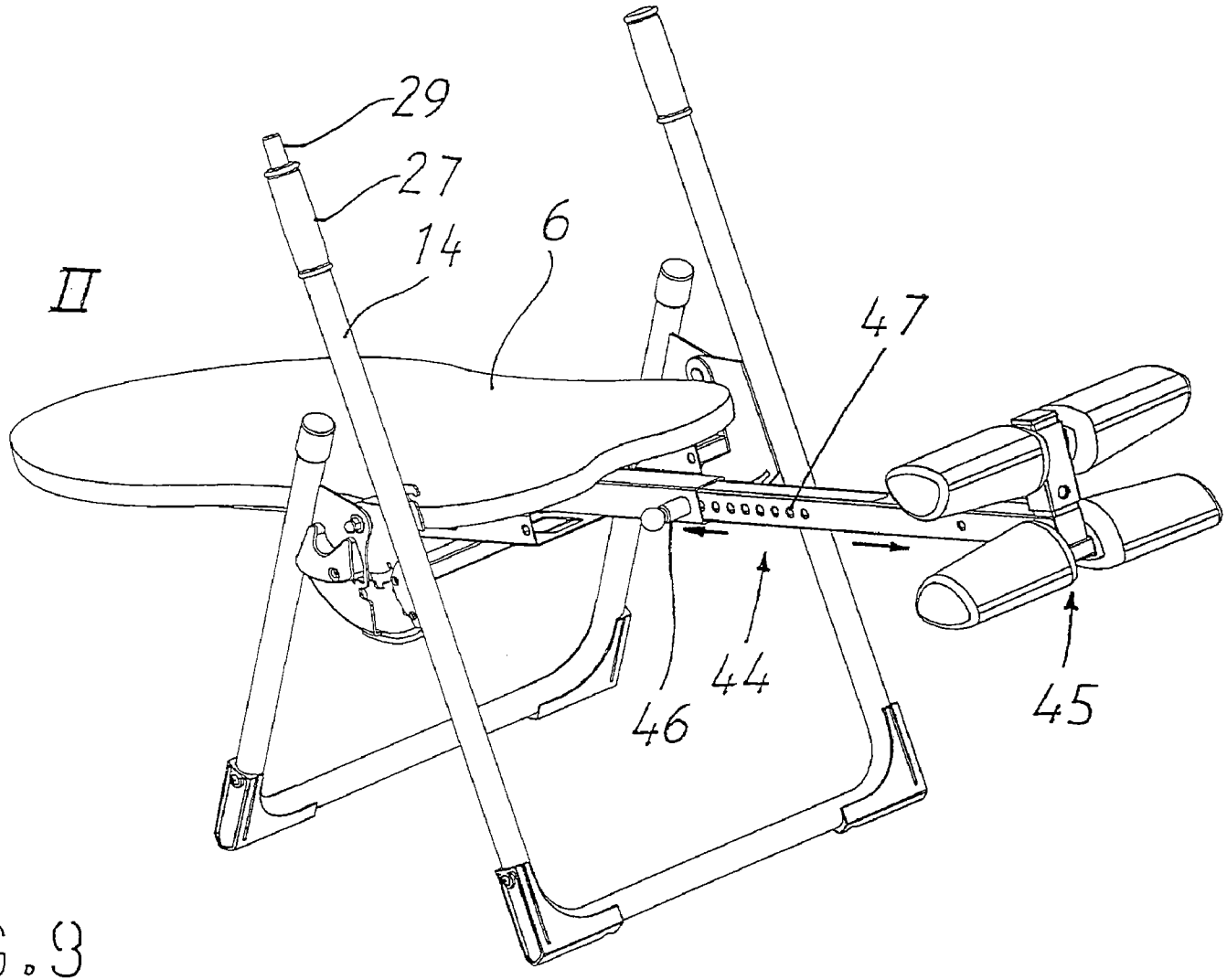
Figure 10:
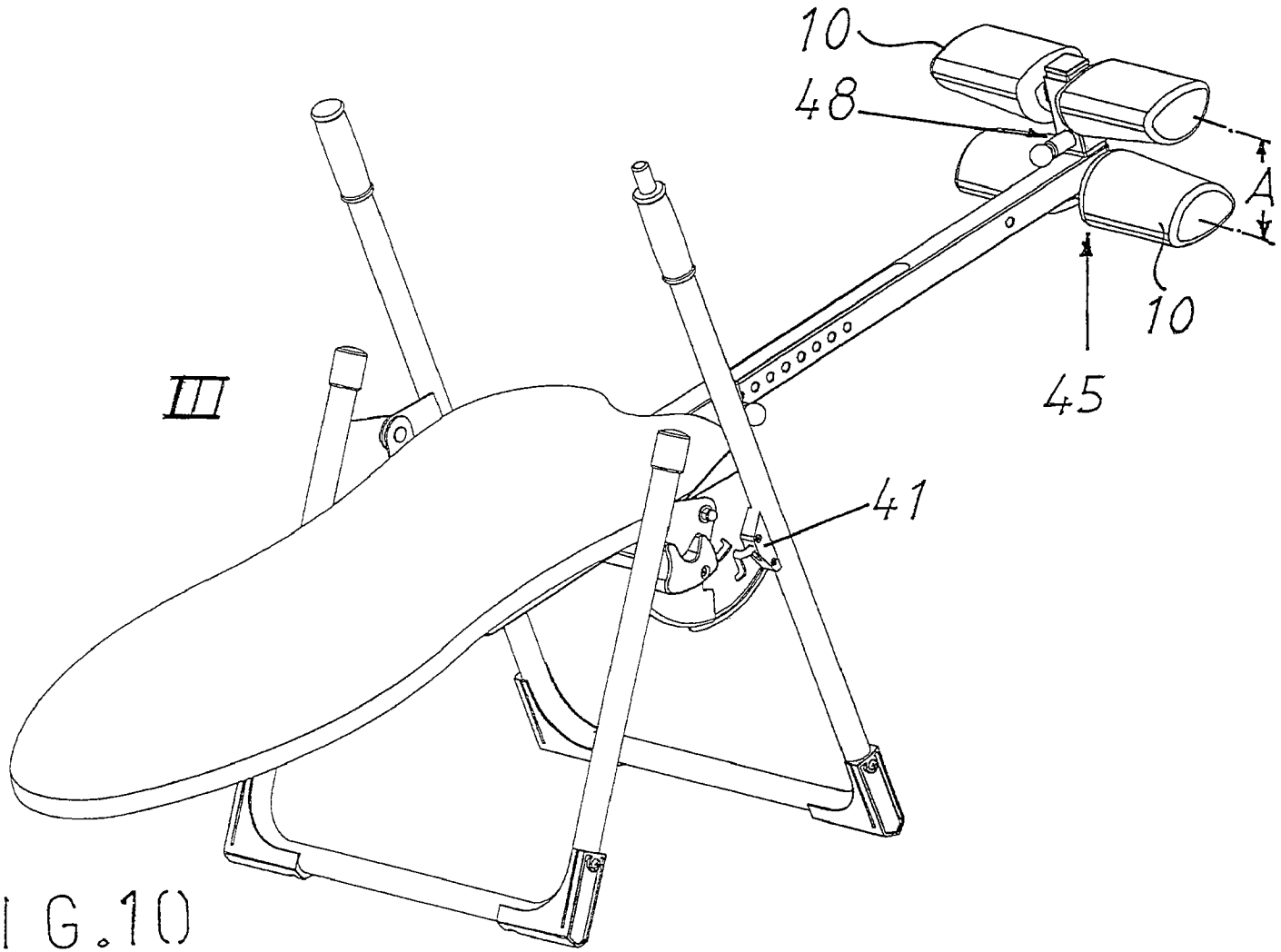
Figure 11:
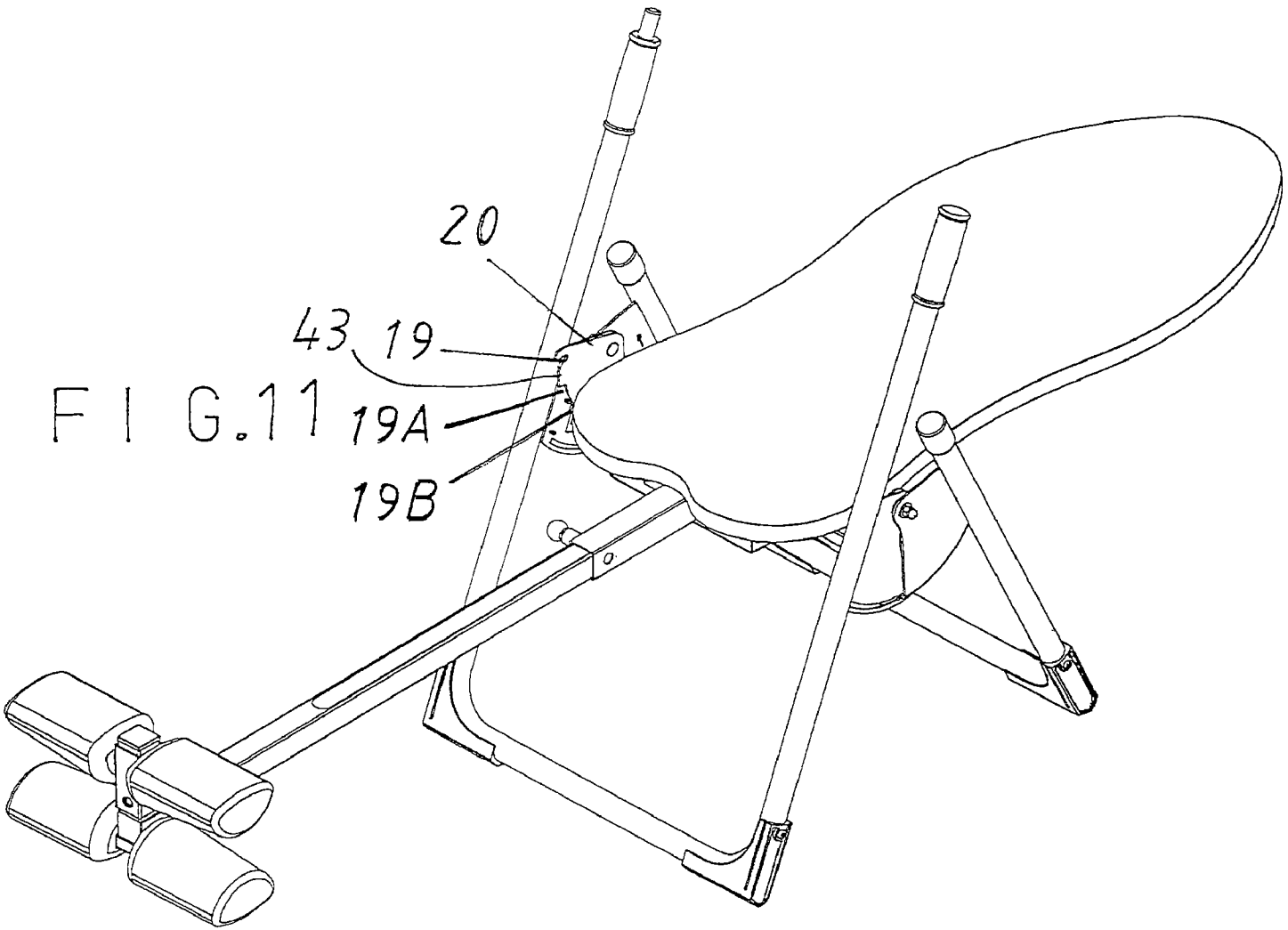

Said preferably L-shaped opening 102 in the stand plate 103 allows the installation of the push rod 11. It is only during the proper installation operation of said push rod 11 that the angled lower part 18 thereof comes into abutment with said opening 102 and is received in the outer angled part thereof to subsequently be received in the opposite portion of the elongate opening, such as is shown in the drawings, e.g., in FIGS. 7-8A. Normally, the push rod 11 does not reach all the way down to the angled part of the opening 102 in the installed position of the push rod 11.

The spring-clamping reception part 21 is threaded from above onto the push rod 11 through the bottom hole 25 of said spring-reception part 21 all the way until the spring 22 bottoms against the end edge 28 of the U-bent stand tube 14. Next, the compression spring 22 is threaded over the push rod all the way until it bottoms in the formed spring holder 21, 24.

The press button 29 is then screwed on to the outer end 11A of the push rod and thereby the compression spring 22 becomes biased. Finally, the handle 27 is fixedly threaded onto the outer end of the U-bent stand tube 14 so that the press button 29 protrudes from the handle 27 and can be actuated manually. The space in the tube 14 is limited by the internal envelope surface 31 thereof, and thanks to the angled deflected portion 30 of the push rod at the intermediate portion thereof, the assembling can be made easily and through a small opening 17 in the tube 14. Thereby, the parts will also be inexpensive and simple to manufacture.

Said angled arresting portion 18, which preferably is double bent including an outer angled portion, is arranged to be adjustable in at least three different positions. Said positions are a so-called "entering position" I shown in the drawings in FIGS. 7, 11, a substantially "horizontal position" II shown in FIGS. 8-9, and a so-called "treatment position" III shown in FIG. 10.

Furthermore, in the drawings, the back bench 2 is shown in a collapsed compact transport position IV, in which the bench 2 is allowed to be raised on a support, e.g., in a wardrobe, a storage space or in another desired location, or to, however not shown in the drawings, be laid under a bed in a horizontal position, preferably with one of the benches stacked on another bench.

End shoes 100 of plastic as well as feet 101, also of plastic, in the corners make that the back bench 2 easily can slide on a floor 4 when it is desired to be able to put the back bench 2 into a storage position under e.g., a bed. This simplifies the handling.

Furthermore, said arresting part 20 is formed of a sector-shaped plate, which has the stoppers 19-19C distributed along the circular arc portion 43 of the plate. Note in that connection that only a single arresting mechanism 9 needs to be arranged, viz. in one of the highest extending tubes 14 of the stand, then suitably in the one to the right as seen when lying in the back bench 2, since most people are right-handed. However, it is possible to change side or have double arresting members.

Furthermore, the back bench 2 has a setting mechanism 44 for length adjustment of the lying part 6 and the leg-clamping member part 45 in relation to each other. For instance, a spring-force-actuated catch 46 may be arranged to be received in the desired hole in a line-shaped collection of holes 47. A similar setting mechanism 48 may be arranged at the leg-clamping member part 45 in order to optionally be allowed to set the outwardly converging leg-clamping members 10 in relation to each other at a desired distance A from each other.

Displacement of the disc-shaped shape-adapted lying part 6 is provided by means of a plurality of line-shapedly distributed reels/wheels 49, 50 attached on the underside 6A of said lying part 6 by means of a spacer 51. The reels/wheels 49, 50, which are conical inward toward a wall 52, 53 of a holder 54 on a transverse beam 55 of the leg stand, are arranged to roll on formed tracks 56, 57 of the holder 54. In that connection, the reels/wheels 49, 50 are guided laterally 58, 59 by the end walls 52, 53 of the holder. On one side 62 of said back bench 2, there is a manually actuable spring-force-actuated catch 63 by means of which the arresting function thereof is disengaged if it is turned out in the direction of the arrow 64, after which the pair of legs can be folded out from the leg position V shown in FIG. 2 to the leg position VI shown in, for instance, FIG. 7.

The function of the invention should have been understood from what has been described above and shown in the drawings, but by using the thumb and simply press down the button 29 by force F that counteracts the counter-directed force of the spring 22, the push rod 11 in the tube 14 is actuated to press down the appurtenant arresting portion 18 thereof so that a desired stopper 19-19C can be selected to be entered.

Naturally, the invention is not limited to the embodiments described above and shown in the accompanying drawings. Modifications are feasible, particularly as for the nature of the different parts, or by using an equivalent technique, without departing from the protection area of the invention, such as it is defined in the claims.

The invention claimed is:

1. A device having a back bench, comprising:

a lying part that is supportable by a stand; the lying part is turnably mounted around a pivot joint and is movable along a longitudinal direction of the lying part;

a manually actuatable mechanism for arresting the lying part in a desired angular setting;

clamping members for the clamping a person's legs; and wherein the arresting mechanism includes a push rod; the push rod has an intermediate portion that has an angled portion and is received internally in a tube included in a leg of the back bench along a way from an outer free end of the tube to an opening on a side of the tube; and the push rod has a lower portion that is angled at an obtuse angle to an arresting portion; and the arresting portion is arranged to be received in a number of stoppers situated at distances from each other on an arresting part on the stand.

2. The device of claim 1, wherein an upper end portion of the push rod is received in a reception part internally in the tube, and is actuable by a spring.

3. The device of claim 2, wherein the spring is received in the reception part.

4. The device of claim 3, wherein the spring is a helical compression spring.

5. The device of claim 3, wherein the reception part is a holed plastic cup through which the push rod extends and which is secured by an end stopper of the cup and a surrounding gripping handle at an upper end of the tube.

6. The device of claim 5, wherein an actuation button is attached on the upper end portion of the push rod.

7. The device of claim 6, wherein the spring is arranged between the actuation button and a bottom portion of the cup.

8. The device of claim 1, wherein the intermediate portion of the push rod has the angled portion that facilitates introduction of the push rod into the opening on the side of the tube.

9. The device of claim 1, wherein the lower portion of the push rod, which is angled at an obtuse angle, is displaceably received in the opening on the side of the tube, and the opening is slot-shaped.

10. The device of claim 9, further comprising an add-on member attached on the tube, wherein the add-on member is a block having a slot-shaped opening receiving the lower portion of the push rod and has a slot-shaped reception channel situated opposite the opening on the side of the tube; and the reception channel guides the push rod and prevents the push rod from turning.

11. The device of claim 10, wherein the arresting portion is manually adjustable to at least three different positions for arresting the lying part in a desired angular setting.

12. The device of claim 1, wherein the arresting part is a sector-shaped plate having the stoppers distributed along a circular arc portion of the plate.

13. The device of claim 1, wherein the push rod, with the arresting portion thereof, is receivable in an L-shaped opening such that, only during proper installation of the push rod, the lower portion of the push rod comes into abutment with the L-shaped opening and the arresting portion is received in an outer angled part thereof to subsequently be received in an opposite portion of the L-shaped opening; whereby the push rod does not reach fully down to the outer angled part of the L-shaped opening in the installed position of the push rod.

* * * * *